US005167283A

United States Patent [19]

Smith et al.

[11] Patent Number: 5,167,283

[45] Date of Patent: Dec. 1, 1992

[54] COMBINATION BALL VALVE AND ANNULAR PIPE SEAL

[75] Inventors: John D. Smith, Houston; William F. Geisler, Richmond, both of Tex.

[73] Assignee: ABB Vetco Gray Inc., Houston, Tex.

[21] Appl. No.: 811,563

[22] Filed: Dec. 20, 1991

[51] Int. Cl.[5] ..... E21B 33/03

[52] U.S. Cl. ..... 166/373; 251/1.2; 277/200

[58] Field of Search ..... 166/88, 379, 366, 373, 166/359, 386, 85, 86, 324; 251/1.1, 1.2, 1.3; 277/34.3, 31, 200

[56] References Cited

U.S. PATENT DOCUMENTS

| | | | |
|---|---|---|---|
| Re. 19,684 | 8/1935 | Young . | |
| 2,071,197 | 2/1937 | Burns et al. | 251/1.2 X |
| 3,363,650 | 10/1963 | Scaramucci . | |
| 3,556,568 | 1/1971 | King . | |
| 3,589,667 | 6/1971 | Lewis . | |
| 3,614,111 | 10/1971 | Regan | 251/1.2 |
| 3,737,139 | 6/1973 | Watte | 251/1.2 |
| 3,791,442 | 2/1974 | Watkins . | |
| 4,358,085 | 11/1982 | Regan et al. | 251/1.2 |
| 4,440,232 | 4/1984 | Le Moine | 166/373 |
| 4,460,150 | 7/1984 | Turlak et al. | 251/1.2 |
| 4,579,314 | 4/1986 | Schaeper et al. | 251/1.2 |
| 4,703,807 | 11/1987 | Weston | 166/373 |
| 5,037,065 | 8/1991 | Hirz et al. | 277/200 |

OTHER PUBLICATIONS

Hughes Drilling Equipment (Hughes Offshore) KFDJ Diverter System.

*Primary Examiner*—Ramon S. Britts
*Assistant Examiner*—Frank S. Tsay
*Attorney, Agent, or Firm*—James E. Bradley

[57] ABSTRACT

A diverter for a riser string between subsea well and offshore drilling rig utilizes a rotatable ball element. The ball element mounts in a tubular housing. The ball element has a passage through it which is coaxial with the riser when the ball element is in one position. A drive motor will rotate the ball element 90 degrees to place the ball element passage perpendicular to the riser passage to block flow. A pipe sealing member locates in the passage of the ball element. Hydraulic fluid pressure applied to the pipe sealing element will causes the pipe sealing element to seal around pipe.

11 Claims, 2 Drawing Sheets

COMBINATION BALL VALVE AND ANNULAR PIPE SEAL

BACKGROUND OF THE INVENTION

1. Field of the invention

This invention relates in general to offshore drilling equipment, and in particular to a diverter assembly that utilizes a ball element which has an annular seal for closing on pipe, and which will rotate 90 degrees for full closure when pipe is not located in the diverter assembly.

2. Description of the Prior Art

In offshore drilling, a diverter is normally employed during the early stage of drilling while the well is still shallow and before a blowout preventer is connected. The diverter is an assembly that mounts directly below the rotary table into the upper end of a string of riser or conduit extending upward from the sea floor. The diverter has a packer or seal element that will close around drill pipe or casing extending through the riser. Diverter outlets extend through the diverter housing.

In the event of a pressure kick encountered before the blowout preventer is installed, the operator will close the diverter to seal around the pipe. The drilling fluid is allowed to flow through the conduit and out the diverter outlet. The well fluid is then diverted through the conduit to vent or flare lines where the oil and gas may be safely disposed of or flared.

One type of diverter employs annular insert packers that insert in the housing. Hydraulic pressure forces the elastomeric insert packers radially inward to seal around the pipe. If the pipe is out of the hole, this type of diverter will not seal well across the bore of the diverter passage.

Another type of diverter employs an inflatable type packer that will seal across the bore of the passage when pipe is not located in the diverter housing. That type of diverter will also seal around the pipe. However, it is large and time consuming to rig up with each new well.

SUMMARY OF THE INVENTION

In this invention, the diverter employs an insert packer that seals around the pipe The insert packer is located within a rotatable ball element. When the pipe is contained within the riser, the ball element will be in a vertical position, with its bore coaxial with the axis of the riser. If it is necessary to close against pipe, hydraulic pressure will be supplied to deform the insert packer inward around the pipe.

If the pipe is out of the hole and if it is necessary to close the conduit to upward flow, then the operator actuates a drive motor to rotate the ball element. The ball element will rotate 90 degrees to a position in which its passage is perpendicular to the axis of the riser. This closes the bore of the diverter to upward flow.

DETAILED DESCRIPTION OF THE INVENTION

Figure 1:
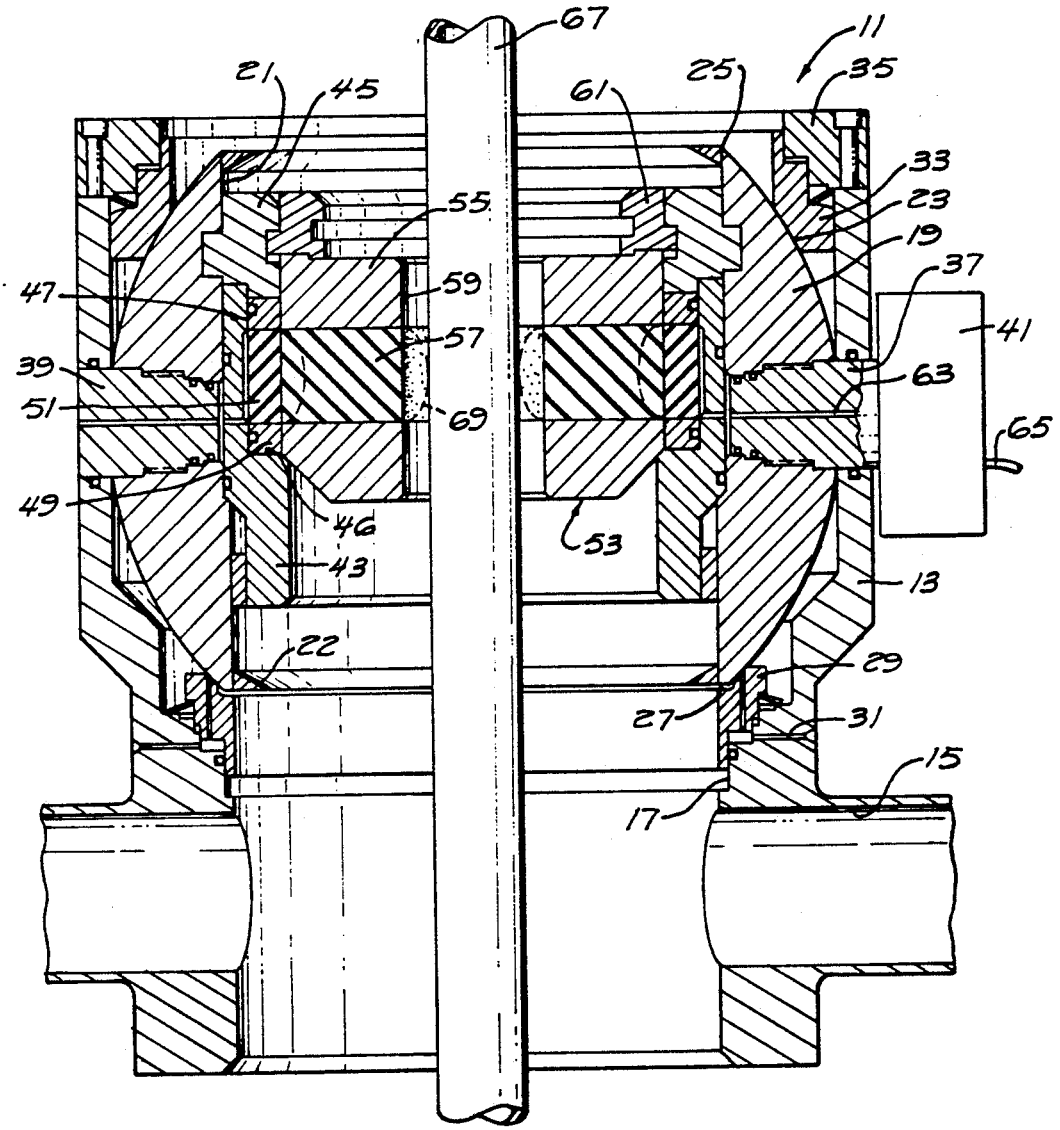
FIG. 1 is a vertical sectional view illustrating a diverter constructed in accordance with this invention, and showing annular elastomeric seal in a position for sealing around pipe.

Referring to FIG. 1, diverter 11 is an assembly that serves as a closure apparatus for closing off a conduit (not shown) extending from the sea floor to a drilling vessel (not shown). The conduit may be a structural pipe extending into the well and up to the rig in the case of a jackup drilling rig. Alternately, the conduit may be a riser secured to and extending upward from an outer wellhead housing in the case of a floating drilling rig.

Diverter 11 includes a tubular housing 13. Housing 13 secures on its upper end to the drilling rig directly below the rotory table (not shown). The lower end of housing 13 will secure to the upper end of the string of conduit. Housing 13 has a pair of diverter outlets 15 located near its lower end. Outlets 15 extend laterally outward for communicating bore 17 of housing 13 with the exterior. Outlets 15 will be connected to valves and other equipment for flaring gas and recirculating drilling fluid that may be flowing up the conduit in case of a pressure kick. Bore 17 has a longitudinal vertical axis that is coaxial with the conduit.

A ball or rotatable element 19 mounts rotatably in housing 13. Ball or rotatable element 19 has a passage 21 and a spherical exterior 23. Spherical exterior 23 is truncated on the upper end 25 and on the lower end 27 of passage 21. A cutting edge 22 locates at the upper end 25 and the lower end 27 of passage 21. Cutting edge 22 is a sharp member of metal harder than ball element 19 and bonded to ball element 19.

A seal ring 29 mounts in bore 17 at the lower end 27 of ball element 19. Seal ring 29 could be of various types. In the embodiment shown, it is a metal-to-metal seal member having an upward facing concave spherical surface for mating with the spherical surface 23. A sealant passage 31 extends through housing 13 and through seal ring 29 for applying a liquid sealant to enhance sealing if necessary. Seal ring 29 will seal the lower end of ball element 19 in bore 17, preventing flow from bore 17 around ball element 19.

A load ring 33 mounts in housing bore 17 at the upper end 25 of ball element 19. Load ring 33 is a metal element similar in appearance to seal ring 29. Load ring 33 also has a downward facing concave portion that mates closely with spherical exterior 23. Load ring 33 resists upward force on ball element 19 due to pressure in the housing 13. Load ring 33 may also have sealing surfaces or contain a seal for sealing against the ball spherical exterior 23. Load ring 33 is retained in housing 13 by an upper retainer ring 35 that bolts to housing 13.

Figure 2:
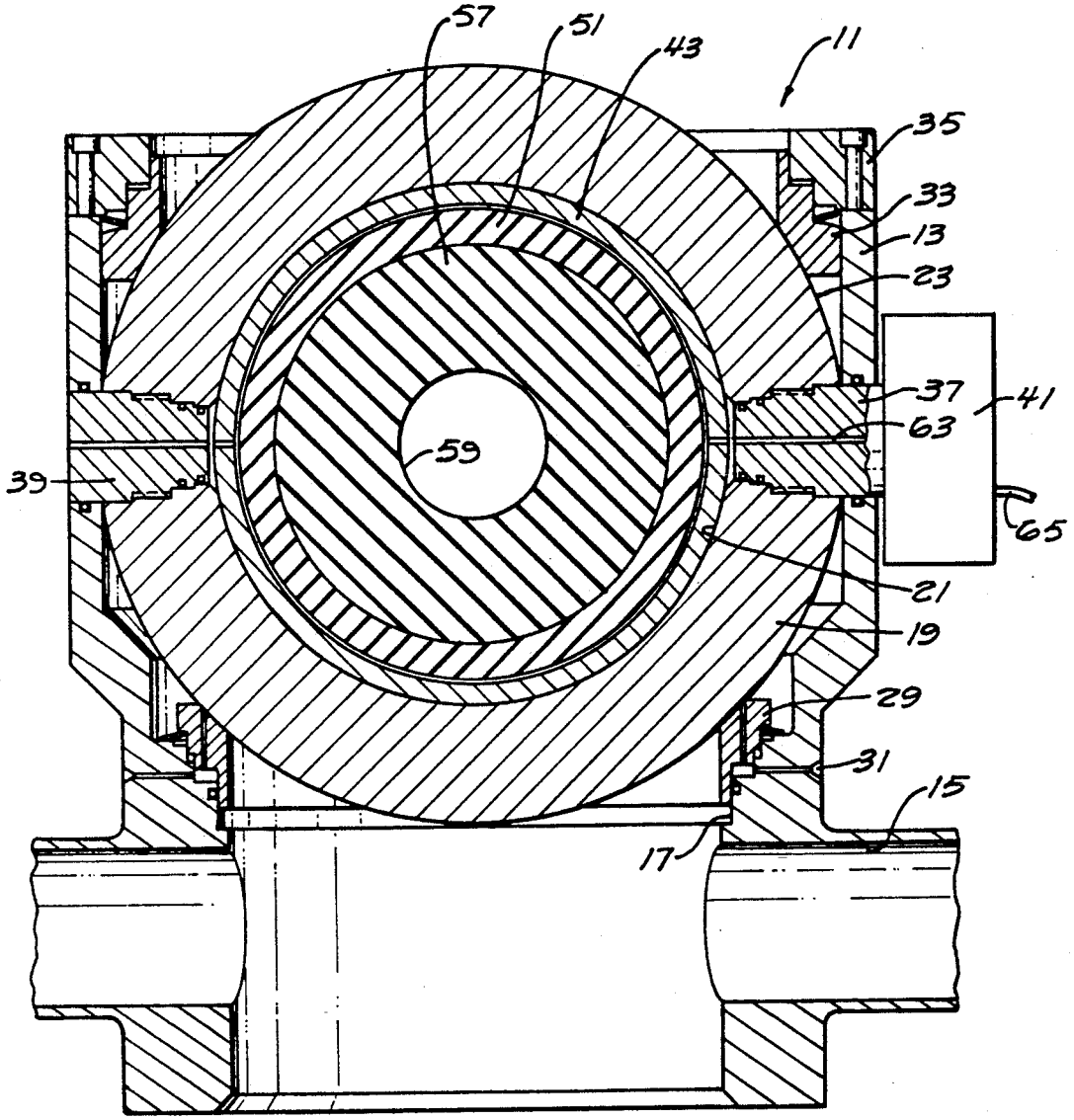
FIG. 2 is a vertical sectional view of the diverter of FIG. 1, showing the ball element rotated 90 degrees from that shown in FIG. 1 for sealing full bore of the diverter housing.

The ball element 19 has means for rotating, which includes horizontally extending axle stubs 37, 39 located on opposite sides. Axle stubs 37, 39 are coaxial and mounted perpendicular to the vertical or longitudinal axis of housing 13. Each axle stub 37 is sealingly and rotatably mounted in a hole extending through housing 13. A drive motor 41 mounts to axle stub 37. Drive motor 41 may be of various types. Preferably it will include gears and is actuated hydraulically for rotating ball element 19 90 degrees from the position shown in FIG. 1 to the position shown in FIG. 2.

A seal assembly locates in ball element passage 21. The seal assembly includes a metal seat ring 43 that lands on an internal shoulder in passage 21. A split retainer ring 45 locates within grooves in passage 21 for retaining seat ring 43 against upward force. Seat ring 43 has an upward facing shoulder 46.

An outer seal member or insert packer 47 is carried on shoulder 46 in seat ring 43 by the split retainer ring 45. Outer insert packer 47 is comprised of three annular parts. It has upper and lower axially spaced apart metal rings 49. An elastomeric seal ring 51 is sandwiched between and bonded to metal rings 49. The rings 49, 51 are continuous annular members.

An inner seal member or insert packer 53 may be inserted into outer insert packer 47. Inner insert packer 53 lands on a portion of shoulder 46. Inner insert packer 53 has an outer diameter that is only slightly less than the inner diameter of outer insert packer 47. Inner insert packer 53 is also made up of three components, which may be continuous annular members as shown or split. These components include axially spaced apart metal rings 55. An elastomeric seal ring 57 sandwiches between and is bonded to metal rings 55. The inner diameters of the rings 55, 57 are the same, providing a passage 59. A split retainer ring 61 will locate within a groove in retainer ring 45 for retaining inner insert packer 53.

Hydraulic fluid passage means will be used to energize the outer insert packer 47 and inner insert packer 53. The hydraulic fluid passage means includes a hydraulic fluid passage 63 extending through axle stub 37. Passage 63 also extends through seat ring 43. These passages connect to a line 65 that leads to the drilling rig for supplying hydraulic fluid pressure.

When a pipe 67 is located within passage 59 of inner insert packer 53, applying hydraulic fluid pressure will deform the inner elastomeric ring 57 to the position shown by dotted lines. In that position, it will close around pipe 67 to block upward flow past the inner elastomeric ring 57.

In operation, diverter 11 will be mounted to the drilling rig directly below the rotary table. Diverter 11 will connect to the upper end of conduit extending to the sea floor. For the passage of large diameter bits or large diameter pipe, the inner insert packer 53 may be removed. If necessary, the seat ring 43 and outer insert packer 47 may also be removed. Once drilling is taking place, the outer insert packer 47 and the inner insert packer 53 will be in place as shown in FIG. 1.

If a high pressure zone is hit, causing drilling fluid and gas to flow back up the pipe, the operator will apply hydraulic fluid pressure to line 65 and passages 63. Hydraulic fluid pressure acts on the outer side of outer seal ring 51, deforming it inward. This deformation pushes inner seal ring 57 inward as indicated by the dotted lines 69. The inner seal ring 57 will seal tightly around pipe 67. Seal ring 29 will seal around the lower end of ball element 19. In this position, diverter 11 will block flow upward past the diverter Valves (not shown) will be opened to allow the fluid flow to flow out the diverter outlets 15 until the well can be controlled by pumping drilling fluid down the drill pipe 67.

Later, if casing is to be run, the inner insert packer 53 can be removed by removing retainer ring 61. The outer insert packer 47 will remain in place for closing around casing if necessary. For casing having diameter significantly greater than drill pipe 67 but less than the inner diameter of the outer insert packer 47, a different inner insert packer 53 may be employed. The different inner insert packer 53 would have a larger inner diameter than the passage 59 shown in FIG. 1.

A possibility exists of a high pressure kick occurring while the drill pipe 67 or casing is out of the hole. In this event, the operator actuates motor 41. Motor 41 will rotate ball element 19 90 degrees. The rotation will be about the horizontal axis of axle stubs 37, 39. In the full closure position, shown in FIG. 2, the diverter 11 fully blocks upward flow due to the seal ring 29 engaging spherical surface 23 of ball element 19. The flow can be diverted through the diverter outlets 15 until control can be obtained.

If significant leakage past the elastomeric ring 57 develops, the operator may need to shear the pipe 67. This is handled by rotating ball element 19 90 degrees with the drive motor 41 while the pipe 67 is still extending through the passage 59. The sharpened edges 22 will shear the pipe 67 in two places. Flow would then by blocked by the seal 29.

The invention has significant advantages. The diverter will close easily on drill pipe, drilling kellys, or casing, thus retaining the standard functional operation of a conventional diverter. When it is required to close an open hole, the ball valve assembly can be rotated to a closed position without removing the insert packers. The diverter is smaller and should be less time consuming to rig up than the prior art inflatable packer types. The forces required to rotate the ball are relatively low. Once the ball is rotated to the closed position, no hydraulic pressure is required to maintain the ball in the closed position.

The insert packers can be removed for larger drill bits or casing to be passed through the diverter. By placing the hydraulic fluid passages through one of the axles, special shaft seals are not required. The lower seal on the spherical surface of the ball valve is forced into tighter contact by pressure, thereby assisting the ability to seal during a high pressure kick.

While the invention has been shown in only one of its forms, it should be apparent to those skilled in the art that it is not so limited, but is susceptible to various changes without departing from the scope of the invention.

We claim:

1. A closure apparatus for a string of conduit extending between a subsea well and an offshore drilling rig and through which strings of pipe are inserted and withdrawn, comprising in combination:

a tubular housing adapted to be mounted to the conduit string, the housing having a bore therethrough which has a vertical axis that is adapted to be coaxial with the conduit;

a rotatable element in the bore of the housing, the rotatable element having a passage through which a pipe may be inserted;

pipe sealing means in the passage of the rotatable element for selective sealing around the pipe to prevent fluid from flowing above the closure apparatus when the pipe is located in the passage; and mounting means for mounting the rotatable element sealingly in the bore of the housing for selective rotation about a horizontal axis perpendicular to the vertical axis from a pipe closure position in which the passage is coaxial with the conduit for receiving and selectively sealing around the pipe with the pipe sealing means, to a full closure position wherein the passage is transverse to the vertical axis to prevent fluid from flowing above the closure apparatus when the pipe is removed from the passage.

2. The closure apparatus according to claim 1 wherein the rotatable element has a central exterior portion that is spherical and coaxial with the passage extending through the rotatable element.

3. The closure apparatus according to claim 1 wherein the mounting means comprises:

an axle having portions extending outward from opposite sides of the rotatable element and rotatably mounted in the housing; and drive means mounted in engagement with the axle for rotating the axle.

4. The closure apparatus according to claim 1 wherein the pipe sealing means comprises:

an annular elastomeric seal member mounted in the passage of the rotatable element; and hydraulic passage means for applying pressure to the seal member to cause it to close around the pipe.

5. The closure apparatus according to claim 1 wherein the apparatus further comprises:

diverter means, including a diverter outlet below the rotatable element to divert upward flowing fluid outward from the conduit in the event the closure apparatus has closed the conduit.

6. A closure apparatus for a string of conduit extending between a subsea well and an offshore drilling rig and through which strings of pipe are inserted and withdrawn, comprising in combination:

a tubular housing adapted to be mounted to the drilling rig at an upper end of the conduit string, the housing having a bore therethrough which has a vertical axis that is adapted to be coaxial with the conduit;

a rotatable element in the bore of the housing, the rotatable element having a passage through which a pipe may be inserted, the rotatable element having a central exterior portion that is spherical;

a seal ring located in the bore of the housing in engagement with the central exterior portion of the rotatable element for sealing between the housing and the rotatable element;

an annular elastomeric seal member located in the passage of the rotatable element;

hydraulic passage means for applying pressure to the seal member for selective sealing around the pipe to prevent fluid from flowing above the closure apparatus when the pipe is located in the conduit;

an axle having portions extending outward from opposite sides of the rotatable element and rotatably mounted in the housing coaxial with a horizontal axis that is perpendicular to the vertical axis;

drive means mounted in engagement with the axle for rotating the axle and the rotatable element about the horizontal axis between a pipe closure position in which the passage is coaxial with the conduit for receiving and selectively sealing around the pipe with the seal member, to a full closure position wherein the passage is transverse to the vertical axis to prevent fluid from flowing above the closure apparatus when the pipe is removed from the passage; and a diverter outlet extending from the bore to the exterior of the housing below the rotatable element to divert upward flowing fluid outward from the conduit in the event the closure apparatus has closed the conduit.

7. The closure apparatus according to claim 6 wherein the hydraulic passages means includes a passage that extends through one of the portions of the axle.

8. The closure apparatus according to claim 6 wherein the seal member comprises:

a pair of spaced apart metal rings;

an elastomeric ring sandwiched between the metal rings, the elastomeric ring and metal rings being insertable into the passage of the rotatable element, with the elastomeric ring exposed on its outer periphery to the pressure from the hydraulic passage means.

9. The closure apparatus according to claim 6 wherein the seal member comprises:

a pair of spaced apart inner metal rings;

an inner elastomeric ring sandwiched between the inner metal rings;

a pair of spaced apart outer metal rings;

an outer elastomeric ring sandwiched between the outer metal rings, defining an outer seal assembly with an inner diameter;

the outer elastomeric ring and the outer metal rings being inserted into the passage of the rotatable element;

the inner elastomeric ring and the inner metal rings defining an inner seal assembly which has an inner diameter and which is insertable into the inner diameter of the outer seal assembly;

the hydraulic passage means applying fluid pressure to the outer seal assembly to deform the outer elastomeric ring inward, which in turn deforms the inner elastomeric ring inward to seal around the pipe; and the inner seal assembly being removable from the outer seal assembly to allow the outer elastomeric ring to seal around pipe of a larger diameter than the inner diameter of the inner seal assembly.

10. A method of closing a string of conduit extending between a subsea well and an offshore drilling rig and through which strings of pipe are inserted and withdrawn, comprising:

mounting a tubular housing to the conduit string, and providing the housing with a bore therethrough which has a vertical axis that is coaxial with the conduit;

mounting a rotatable element sealingly in the bore of the housing, and providing the rotatable element with a passage through which a pipe may be inserted;

mounting a seal member in the passage of the rotatable element and when required, actuating the seal member to seal around the pipe to prevent fluid from flowing above the rotatable element when the pipe is located in the conduit; and when required, and when the pipe is not located in the passage of the rotatable element, rotating the rotatable element to a full closure position wherein the passage is transverse to the conduit to prevent fluid from flowing above the rotatable element when the pipe is removed from the passage.

11. The method according to claim 10 further comprising:

providing a diverter outlet in the housing below the rotatable element; and causing fluid to flow out the diverter outlet when fluid flow int h conduit si blocked form flowing above the rotatable element.

* * * * *